United States Patent [19]

Fujiki et al.

[11] Patent Number: 4,844,024

[45] Date of Patent: Jul. 4, 1989

[54] HEAT RESISTANT AND WEAR RESISTANT IRON-BASE SINTERED ALLOY

[75] Inventors: Akira Fujiki; Yoshiteru Yasuda, both of Yokosuka; Ichiro Tanimoto, Yokohama; Hiroyuki Endo, Abiko; Yutaka Ikenoue, Matsudo; Keitaro Suzuki, Abiko, all of Japan

[73] Assignees: Nissan Motor Co., Ltd., Yokohama; Hitachi Powdered Metals Co., Ltd., Matsudo, both of Japan

[21] Appl. No.: 213,868

[22] Filed: Jun. 30, 1988

[30] Foreign Application Priority Data

Jul. 7, 1987 [JP] Japan ..... 62-167767

[51] Int. Cl.[4] ..... F01L 3/00

[52] U.S. Cl. ..... 123/188.5; 251/358; 75/238

[58] Field of Search ..... 123/188 S, 188 AA; 251/358; 75/238

[56] References Cited

U.S. PATENT DOCUMENTS 4,648,903 3/1987 Ikenoue et al. ..... 75/230

4,734,968 4/1988 Kuroishi et al. ..... 123/188 S 4,778,522 10/1988 Maki et al. ..... 75/238

*Primary Examiner*—E. Rollins Cross

*Attorney, Agent, or Firm*—Foley & Lardner, Schwartz, Jeffery, Schwaab, Mack, Blumenthal & Evans

[57] ABSTRACT

A heat resistant and wear resistant iron-base sintered alloy to be used as the material of a valve seat and a valve face of an engine valve and a waste gate valve of a turbocharger for an internal combustion engine. The iron-base sintered alloy consists essentially of at least one of molybdenum and tungsten, ranging from 3 to 25% by weight, chromium ranging from 1 to 10% by weight, silicon ranging from 0.1 to 0.9% by weight, manganese ranging not more than 0.7% by weight, phosphorus ranging not more than 0.05% by weight, carbon ranging from 0.1 to 2.5% by weight, boron ranging from 0.5 to 2.0% by weight, intermetallic compound of TiAl ranging from 0.3 to 20% by weight, and balance including iron and impurities. In the sintered alloy, carbide, boride and/or carbide boride and TiAl are uniformly dispersed in the matrix, thereby strengthening grain boundary.

6 Claims, No Drawings

HEAT RESISTANT AND WEAR RESISTANT IRON-BASE SINTERED ALLOY

BACKGROUND OF THE INVENTION

1. Field of the Invention

This invention relates in general to a heat resistant and wear resistant iron-base sintered alloy as the material of a component part which requires heat resistance and wear resistance at high temperatures while exhibiting a low attacking ability and high concordance against an opposite member, and more particularly to the material suitable for a valve seat and a valve face of an engine valve and a waste gate valve of a turbocharger for an internal combustion engine.

2. Description of the Prior Art

In recent years, wear of component parts of an engine valve system for an internal combustion engine has become issue with requirement of increasing engine speed and engine power output, in which particularly valve seats require excellent oxidation resistance, friction characteristics and durability at high temperatures under severe high temperature engine combustion conditions. In this connection, a turbocharger is also required to be formed of a material durable in oxidation and friction at high temperatures.

Thus, since such component parts of the engine are subjected not only to high temperatures but also to friction and hammering, they are required to be formed of a material having high heat resistance, wear resistance and pitting resistance together with concordance with the material of an opposite member. Accordingly, such a high performance material has been eagerly desired.

SUMMARY OF THE INVENTION

It is an object of the present invention to provide an improved iron-base sintered alloy which is high in wear resistance at high temperatures and suitable for the material of a valve seat and a valve face of an engine valve and a waste gate valve of a turbocharger for an internal combustion engine.

The present invention has been achieved on the basis of the following information recognized by the present inventors as a result of a variety of experiments and research and development on strengthening grain boundary and wear resistance: The heat resistance and wear resistance of a matrix is improved when TiAl ($Ll_0$ type intermetallic compound) is suitably uniformly dispersed in the matrix, the TiAl increasing in its strength with rise of temperature and being excellent in wear resistance. Particularly, in the case when a part of the boron forms boride and/or carbide-boride and exists in the matrix as solid solution, adhesion between TiAl and the matrix is greatly improved and grain boundary is strengthened thus improving heat resistance and wear resistance of the iron-base sintered alloy.

According to the present invention, the heat resistant and wear resistant sintered, iron-base alloy consists essentially of at least one selected from the group consisting of molybdenum and tungsten, ranging from 3 to 25% by weight, chromium ranging from 1 to 10% by weight, silicon ranging from 0.1 to 0.9% by weight, manganese ranging not more than 0.7% by weight, phosphorus ranging not more than 0.05% by weight, carbon ranging from 0.1 to 2.5% by weight, boron ranging from 0.5 to 2.0% by weight, intermetallic compound of TiAl ranging from 0.3 to 20% by weight, and balance including iron and impurities.

Thus, fine, multiple carbide, boride and/or carbide-boride is uniformly dispersed as hard grains in the matrix. Further uniformly and suitably disposed in the matrix is TiAl ($Ll_0$ type intermetallic compound) which is excellent in wear resistance and has so-called reverse temperature-dependency in which strength increases with rise of temperature. Therefore, the iron-base sintered alloy exhibits very excellent heat resistance and wear resistance when used as the material of a component part which requires high heat resistance and high wear resistance at high temperatures.

DETAILED DESCRIPTION OF THE INVENTION

According to the present invention, a heat resistant and wear resistant iron-base, sintered alloy consists essentially of at least one selected from the group consisting of molybdenum and tungsten, ranging from 3 to 25% by weight, chromium ranging from 1 to 10% by weight, silicon ranging from 0.1 to 0.9% by weight, manganese ranging not more than 0.7% by weight, phosphorus ranging not more than 0.05% by weight, carbon ranging from 0.1 to 2.5% by weight, boron ranging from 0.5 to 2.0% by weight, intermetallic compount of TiAl ranging from 0.3 to 20% by weight, and balance including iron and impurities.

It has been confirmed that the heat resistant and wear resistant iron-base, sintered alloy having the above-mentioned composition exhibits an excellent heat resistance and good wear resistance particularly when sufficient amounts of fine carbide and fine boride and/or carbide-boride are uniformly dispersed in the matrix of the sintered alloy, and a sufficient amount of TiAl ($Ll_0$ type intermetallic compound) is dispersed in the matrix of the sintered alloy. It has been confirmed that the sintered alloy of the present invention also exhibits excellent heat resistance and wear resistance when applied to a valve seat and a valve face or seating surface (contactable with the valve seat) of an engine valve such as an intake or exhaust valve, and also when applied to a waste gate valve of a turbocharger or the like of an internal combustion engine.

Reasons for defining the composition of the heat resistant and wear resistant iron-base sintered alloy of the present invention will be hereinafter discussed.

Mo and W:

Mo (molybdenum) and W (tungsten) are combined with C (carbon) and B (boron) to form multiple carbide, multiple boride, and multiple carbide-boride. Fe (iron) and Cr (chromium) also combine with C and B to form multiple carbide, multiple boride and multiple carbide-boride. Such multiple carbide, multiple boride and multiple carbide-boride provide wear resistance to the sintered alloy, when a portion thereof exists in the matrix in the form of solid solution thereby to strengthen the matrix and to improve temper hardenability However, if the content of Mo and W is less than 3% by weight, such advantageous effect cannot be obtained to a desirable extent and if the content exceeds 25% by weight, a further improvement of such effect cannot be recognized while providing disadvantages from the economical view point. Accordingly, the content of at least one of Mo and W is to be within a range from 3 to 25% by weight.

Cr:

Cr (chromium) forms multiple carbide and multiple boride together with Mo, W and the like, thereby improving wear resistance of the sintered alloy, improving hardenability upon existing in the matrix in the form of solid solution, improving temper harden ability, and improving corrosion resistance of the matrix. If the content of Cr is less than 1%, such advantageous effect cannot be recognized. If the content exceeds 10%, not only is further improvement not recognized, but also mechanical strength of the sintered alloy is lowered which unavoidably increases attacking ability against material of an opposite member to which the sintered alloy contacts. Thus, the content of Cr is to be within a range from 1 to 10% by weight.

Si:

If the content of Si (silicon) is less than 0.1% by weight, deoxidation effect is less thus to increasing oxygen content in powder to be sintered, and lowering sintering ability while coarse plate-shape carbide of $M_2C$ tends to crystallize thereby lowering concordance with the material of the opposite member. If the content exceeds 0.9% by weight, deoxidation effect is not improved and the powder particle is rounded thereby lowering the compactibility. Thus, the content of Si is to be within a range from 0.1 to 0.9% by weight.

Mn:

Mn (manganese) has deoxidation effect like the above-mentioned Si and therefore lowers oxygen content in powder to be sintered thus improving sintering ability of the powder. If the content of Mn exceeds 0.7% by weight, the shape of the powder is rounded thereby lowering compactibility of the powder while allowing the edge section of a compacted or sintered body to tend to break off. Thus, the content of Mn is decided to be within a range not more than 0.7% by weight.

P:

In general, a method in which about 0.2 to 0.8% by weight of P (phosphorus) is added as an element for promoting sintering has been used in wear resistant sintered alloys. However according to the present invention, the content of P is decided to be within a range not more than 0.05% by weight for the reasons set forth below: If the content of P exceeds 0.05% by weight, multiple boride or multiple carbide-boride are coarsened which lowers concordance with the material of the opposite member, and in addition multiple boride or multiple carbide-boride unavoidably crystallizes in the form of a network at the grain boundary thereby lowering the strength of the alloy and pitting resistance of the alloy. Thus, the content of P is to be not more than 0.05% by weight.

C:

A part of C (carbon) combines with carbide forming elements such as Mo, W, Cr and V to form multiple carbide thereby improving wear resistance of the alloy. The remainder of C exists in the form of solid solution in the matrix thereby providing high room temperature hardness and strength. However, if the content of C is less than 0.1% by weight, such advantageous effect cannot be recognized. If the content exceeds 2.5% by weight, multiple carbide increases in its crystallized amount and is coarsened thereby lowering concordance with the material of the opposite member. Thus, the content of C is to be within a range from 0.1 to 2.5% by weight.

The C is preferably added in the form of Fe-Mo-W-Cr-V-Si-(Mn)-(V)-(Co)-C atomized alloy powder which is subjected to vacuum annealing. This is because if C is added singly in the form of graphite powder, it combines with Fe-B and Fe-Cr-B which are added as a source of B (boron) in which case coarse carbide-boride will crystallize out along grain boundary during sintering thereby increasing the attacking ability against the material of the opposite member.

B:

B (boron) forms multiple boride upon combining with Mo, W, V, Cr, and Fe, thereby providing wear resistance, when a part of B exists in the form of solid solution in the matrix, thereby improving hardenability of the alloy. Boron improves the wetting property of TiAl with the matrix and therefore functions to strengthen the grain boundary of the matrix. Additionally, a part of the above-mentioned multiple boride combines with C to form multiple carbide-boride thereby improving wear resistance of the alloy.

Thus, B is an essential element to form fine multiple boride or multiple carboride-boride to improve wear resistance and concordance of the sintered alloy according to the present invention. However, if the content of B is less than 0.5% by weight, such advantageous effect cannot be recognized. However if the content exceeds 2.0% by weight, not only is further improvement in the advantageous effect not be recognized but also multiple boride is coarsened thereby lowering concordance with the material of the opposite member. Thus, the content of B is to be within a range from 0.5 to 2.0% by weight.

TiAl:

TiAl is an intermetallic compound in the form of a face-centered cubic crystal of $Ll_0$ type and has about 60% of metallic bond and about 40% of covalent bond. TiAl has nearly the same electric and heat conductivities as in pure Ti and is good in oxidation resistance. TiAl exhibits a strong reverse temperature-dependency so that its strength rises with a rise of temperature within a range of up to 800° C. TiAl is previously formed as the compound, and thereafter finely pulverized and dispersed in the matrix. This improves the heat resistance of the matrix under the effect of dispersion strengthening mechanism.

In this connection, boron as one of the essential elements of the sintered alloy of the present invention effectively suppresses the tendency of making irregular a regular structure of the metallic compound and functions to maintain the strong reverse temperature-dependency. Additionally, TiAl also functions to prevent coarsening of crystal grain and hard phase during sintering. These effects in combination contribute to great improvements in heat resistance and wear reesistance of the sintered alloy. However, if the content of TiAl is less than 0.3% by weight, a desired effect cannot be obtained; and if it exceeds 20% by weight, a further improved effect cannot be obtained while being not economical. Thus, the content of TiAl is to be within a range from 0.3 to 20% by weight.

In addition, the above-discussed sintered alloy of the present invention can offer improved effects upon containing at least one of V (vanadium), Nb (niobium), Ta (tantalum), Ti (titanium), Zr (Zirconium), Hf (hafnium), Co (cobalt) and Ni (nickel) in a total amount of 20% by weight.

Nb, Ta:

V (vanadium), Nb (niobium), and Ta (tantalum) combine with C together with Fe and Cr to form very hard multiple carbide and form multiple carbide and multiple boride of the type wherein a part of Mo and W is substituted with them thereby providing wear resistance, and in which a part of them exists in the form of solid solution in the matrix thereby strengthening the matrix and improving temper hardenability. Additionally, V, Nb, and Ta prevents coarsening of crystal grain during sintering and coarsening of carbide. If the content of at least one of V, Nb, and Ta is less than 0.5 % by weight, such advantageous effect is hardly recognized s0 that wear resistance and strength of the alloy are lowered. However if the content exceeds 8% by weight, a further improvement cannot be recognized while providing economical disadvantage. Thus, in case where at least one of V, Nb, and Ta is preferably added, the content of at least one of them is selected to be within a range from 0.5 to 8.0% by weight.

Ti, Zr, Hf, Co:

At least one of Ti (titanium), Zr (zirconium), Hf (hafnium), Co (cobalt) and the like as boride forming elements may be added in an amount or content forms multiple boride upon being substitued with a part of Mo, W and the like but also exists in the form of solid solution in the matrix thereby improving hardness of the alloy at high temperatures. Accordingly, addition of Co is particularly effective in case where the alloy is used at high temperatures.

Ni:

Ni (nickel) is an element contributing to an improvement in corrosion resistance and heat resistance of the alloy and therefore may be added in an amount within a range where the hardness of the alloy does not lower.

It is to be noted that even if at least one of V, Nb, Ta, Ti, Zr, Hf, Co and Ni is added in a total amount exceeding 20% by weight, a further improved effect cannot be obtained while being not economical. Therefore, the total content of them is preferably not more than 20% by weight.

EXAMPLES

In order to evaluate the heat resistant and wear resistant iron-base sintered alloy according to the present invention, Examples of the present invention will be discussed hereinafter in comparison with Comparative Examples which are not within the scope of the present invention.

Used as raw material atomized powders of Fe-Mo-W-Cr-Si-C were vacuum-annealed (V, Nb, Ta, and Co were added if necessary) having a particle size of −100 mesh Fe-Mo powder or pure Mo powder each having a particle size of −325 mesh, Fe-W powder or pure W powder each having a particle size of −325 mesh, Fe-20%B alloy powder having a particle size of −250 mesh, Fe-26%P alloy powder having a particle size of −250 mesh, TiAl powder having a particle size of −325 mesh ferrotitanium, ferrozirconium, ferrohafnium alloy powders each having a particle size of −250 mesh, carbonyl nickel powder having a particle size of −325 mesh, and the like. These raw material powders were suitably blended to prepare a variety of sample powders corresponding to sintered alloys having compositions shown in Table 1. Higher fatty acid as lubricant was added to the sample powder and mixed to obtain mixed powder. This mixed powder was compacted into a predetermined shape under a pressure of 6 tonf/cm$^2$. The thus obtained compacted powder body was then maintained in vacuum at 1150°-250° C for 60 minutes to be sintered to thereby obtain a sintered alloy. Thereafter, the sintered alloy was subjected to quenching and tempering treatments to thus obtain Example alloys (as the Examples) Nos. 1-7 according to the present invention and Comparative Example Alloys (as the Comparative Examples) Nos. 1-4 as shown in Table 1

Subsequently, each of the resultant Example alloys Nos. 1 to 7 and the Comparative Example alloys Nos. 1 to 4 was machined into the shape of a valve seat of an engine valve for an internal combustion engine. An abrasion test was conducted on each alloy by using a valve and valve seat tester simulating an actual engine. The tester was arranged such that a valve was operated to make opening and closing actions upon operation of an eccentric cam while rotating the valve by a valve rotator, under a condition in which the valve and the valve seat were heated upon combustion of liquified petroleum gas while automatically regulating the temperatures of them. This test reproduced hammering abrasion of the valve and the valve seat and was conducted under the following conditions: The atmosphere surrounding the valve and the valve seat was burnt liquified petroleum gas atmosphere; the material of the valve was SUH 36 (according to Japanese Industrial Standard); the temperature of the valve was 900° C; the temperature of the valve seat was 500° C; the stroke of the valve was 7.0 mm; and the operating or test time was 200 hours. After this test, the depth of abrasion of the valve and the valve seat (formed of the Example alloy or the Comparative Example alloy) was measured to obtain the result shown in Table 1. Additionally, the appearance of the valve seat was observed to obtain the result shown also in Table 1.

As apparent from the test results shown in Table 1, since the test was conducted at a high temperature and under a severe wear condition due to rotation of the valve and the like, the valve seats formed of the Comparative Example alloys No. 1 to 4 (not within the scope of the present invention) exhibited an excessive abrasion, while providing an excessive abrasion against the valve as the opposite member. Further, pitting was found in the valve seats. Thus, the valve seats formed of the alloys not within the scope of the present invention did not exhibit good performance.

In contrast, the valve seats formed of the Example alloys 1 to 7 (according to the present invention) were abraded less while causing less abrasion of the valve seat as the opposite member. Additionally, pitting was not found in the valve seats. Thus, the valve seats formed of the alloys within the scope of the present invention exhibited high performance, such as excellent heat resistance and wear resistance.

TABLE 1

| Alloys | | Composition (wt %) | | | | | | | | | | | | | | | | | |
|---|---|---|---|---|---|---|---|---|---|---|---|---|---|---|---|---|---|---|---|
| Kind | No. | Fe | Mo | W | Cr | Si | Mn | P | C | B | TiAl | V | Nb | Ta | Ti | Zr | Hf | Co | Ni |
| Example | 1 | balance | 10.0 | 2.0 | 4.0 | 0.3 | 0.5 | 0.01 | 1.45 | 0.7 | 5.0 | — | — | — | — | — | — | — | — |
| alloy | 2 | balance | — | 15.0 | 3.5 | 0.2 | 0.4 | 0.01 | 0.70 | 1.0 | 11.0 | — | — | — | — | — | — | — | — |
| (present | 3 | balance | 18.0 | — | 5.0 | 0.3 | 0.4 | 0.01 | 0.80 | 0.7 | 12.0 | — | — | — | — | — | — | — | |
| inven- | 4 | balance | 5.0 | 5.0 | 2.0 | 0.3 | 0.5 | 0.01 | 0.50 | 0.5 | 7.0 | 0.3 | — | 1.0 | — | 1.0 | — | — | 0.5 |
| tion) | 5 | balance | 9.0 | 3.0 | 4.5 | 0.2 | 0.4 | 0.01 | 0.50 | 0.5 | 6.0 | — | — | — | 2.0 | — | 0.7 | 0.5 | — |
| | 6 | balance | 2.5 | 13.0 | 2.0 | 0.3 | 0.5 | 0.01 | 0.45 | 0.7 | 15.0 | 1.5 | 2.0 | — | — | — | — | — | 1.0 |

TABLE 1-continued

| | | | | | | | | | | | | | | | | | | | |
|---|---|---|---|---|---|---|---|---|---|---|---|---|---|---|---|---|---|---|---|
| | 7 | balance | 10.0 | 2.0 | 5.0 | 0.5 | 0.3 | 0.01 | 0.80 | 0.5 | 2.0 | — | — | 1.0 | — | 1.0 | — | 1.0 | — |
| Compara- | 1 | balance | 10.0 | 3.2 | 4.0 | 0.3 | 0.5 | 0.01 | 0.30 | 0.5 | — | — | — | — | — | — | — | — | — |
| tive | 2 | balance | 12.0 | 5.0 | 2.0 | 0.2 | 0.4 | 0.01 | 0.70 | 0.8 | 57 | — | — | — | — | — | — | — | — |
| example | 3 | balance | 15.0 | 2.0 | 3.5 | 0.3 | 0.3 | 0.02 | 1.00 | 3.7 | — | 1.5 | — | — | 0.5 | — | — | — | 3.0 |
| alloy | 4 | balance | 10.0 | 3.5 | 4.0 | 0.3 | 0.5 | 0.80 | 0.80 | 0.7 | 10.0 | — | 2.0 | — | — | — | 2.0 | — | 1.5 |

| Alloys | | Abrasion test result | | |
|---|---|---|---|---|
| Kind | No. | Abrasion depth (mm) of valve | Abrasion depth (mm) of valve seat | Appearance of valve seat |
| Example alloy (present invention) | 1 | 0.03 | 0.04 | No pitting (normal) |
| | 2 | 0.04 | 0.03 | |
| | 3 | 0.05 | 0.02 | |
| | 4 | 0.03 | 0.03 | |
| | 5 | 0.025 | 0.03 | |
| | 6 | 0.03 | 0.035 | |
| | 7 | 0.05 | 0.05 | |
| Comparative example alloy | 1 | 0.17 | 0.30 | Large pitting formed |
| | 2 | 0.20 | 0.25 | Pitting formed |
| | 3 | 0.22 | 0.35 | Large pitting formed |
| | 4 | 0.31 | 0.42 | Large pitting formed |

What is claimed i s:

1. A heat resistant and wear resistant iron-base sintered alloy consisting essentially of at least one selected from the group consisting of molybdenum and tungsten, ranging from 3 to 25% by weight, chromium ranging from 1 to 10% by weight, silicon ranging from 0.1 to 0.9% by weight, manganese ranging not more than 0.7% by weight, phosphorus ranging not more than 0.05% by weight, carbon ranging from 0.1 to 2.5% by weight, boron ranging from 0.5 to 2.0% by weight, intermetallic compound of TiAl ranging from 0.3 to 20% by weight, and balance including iron and impurities.

2. A heat resistant and wear resistant iron-base sintered alloy as claimed in claim 1, further consisting essentially of at least one selected from the group consisting of vanadium, niobium, tantalum, titanium, zirconium, hafnium, cobalt and nickel, ranging not more than 20% by weight.

3. A heat resistant and wear resistant iron-base sintered alloy as claimed in claim 1, further consisting essentially of at least one selected from the group consisting of vanadium, niobium and tantalum, ranging from 0.5 to 8% by weight.

4. A heat resistant and wear resistant iron-base sintered alloy consisting essentially of at least one selected from the group consisting of molybdenum and tungsten, ranging from 3 to 25% by weight, chromium ranging from 1 to 10% by weight, silicon ranging from 0.1 to 0.9% by weight, manganese ranging not more than 0.7% by weight, phosphorus ranging not more than 0.05% by weight, carbon ranging from 0.1 to 2.5% by weight, boron ranging from 0.5 to 2.0% by weight, intermetallic compound of TiAl ranging from 0.3 to 20% by weight, and balance including iron and impurities, wherein said sintered alloy comprising at least one of carbide, boride and carbide-boride dispersed in matrix of the sintered alloy, at least a part said carbon forming part of a part of said carbide and carbide-boride, at least a part of said boron forming part of said boride and said carbide boride.

5. A component part of an internal combustion engine which part is subjected to impact and friction at high temperatures, said component part being formed of a heat resistant and wear resistant iron-base sintered alloy consisting essentially of at least one selected from the group consisting of molybdenum and tungsten, ranging from 3 to 25% by weight, chromium ranging from 1 to 10% by weight, silicon ranging from 0.1 to 0.9% by weight, manganese ranging not more than 0.7% by weight, phosphorus ranging not more than 0.05% by weight, carbon ranging from 0.1 to 2.5% by weight, boron ranging from 0.5 to 2.0% by weight, intermetallic compound of TiAl ranging from 0.3 to 20% by weight, and balance including iron and impurities.

6. A valve seat of an engine valve for an internal combustion engine, said valve seat being formed of heat resistant and wear resistant iron-base sintered alloy consisting essentially of at least one selected from the group consisting of molybdenum and tungsten, ranging from 3 to 25% by weight, chromium ranging from 1 to 10% by weight, silicon ranging from 0.1 to 0.9% by weight, manganese ranging not more than 0.7% by weight, phosphorus ranging not more than 0.05% by weight, carbon ranging from 0.1 to 2.5% by weight, boron ranging from 0.5 to 2.0% by weight, intermetallic compound of TiAl ranging from 0.3 to 20% by weight, and balance including iron and impurities.

* * * * *